US006574932B2

(12) United States Patent
Layne et al.

(10) Patent No.: US 6,574,932 B2
(45) Date of Patent: Jun. 10, 2003

(54) EMBEDDABLE AIR DUCT BLOCK AND METHOD

(75) Inventors: Harry R. Layne, Covington, LA (US); Harbert S. Gregory, Covington, LA (US)

(73) Assignee: Steel Block, Inc., Covington, LA (US)

( * ) Notice: Subject to any disclaimer, the term of this patent is extended or adjusted under 35 U.S.C. 154(b) by 0 days.

(21) Appl. No.: 09/801,749

(22) Filed: Mar. 9, 2001

(65) Prior Publication Data

US 2002/0124495 A1 Sep. 12, 2002

(51) Int. Cl.[7] ..... E04F 17/04

(52) U.S. Cl. ..... 52/302.4; 52/220.8; 52/503; 454/243; 454/245; 454/270; 454/271

(58) Field of Search ..... 52/302.1, 302.3, 52/302.4, 503, 220.8, 302.6, 27; 454/243, 245, 193, 187, 270–274, 706, 330

(56) References Cited

U.S. PATENT DOCUMENTS 5,649,391 A 7/1997 Layne
6,111,197 A 8/2000 Layne
6,265,657 B1 7/2001 Layne

*Primary Examiner*—Carl D. Friedman
*Assistant Examiner*—Yvonne M. Horton
(74) *Attorney, Agent, or Firm*—Shinjyu Global IP Counselors, LLP

(57) ABSTRACT

An embeddable air duct block includes a tubular member extending between a pair of rectangular plate members spaced from each other. The tubular member has a pair of open ends and an interior passageway. One plate member has an inner surface coupled to one open end and a plurality of holes in fluid communication with the interior passageway. The other plate member is coupled to the tubular member and has a duct opening aligned with the interior passageway. Two cement cavities are preferably formed on opposite sides of the tubular member. An air duct is formed in a concrete block wall by installing and securing the air duct block in the concrete block wall. The blocks are coupled together by cementing slurry poured into the cavities. Optionally, reinforcing bars can also be utilized within the cement cavities and at least one cavity of the concrete block wall.

34 Claims, 6 Drawing Sheets

EMBEDDABLE AIR DUCT BLOCK AND METHOD

BACKGROUND OF THE INVENTION

1. Field of the Invention

This invention generally relates to an embeddable air duct block, which is mounted in a block wall. More specifically, the present invention relates to an embeddable air duct block, which is permanently secured or laid within a concrete block or masonry wall during normal construction to provide an air duct in a security facility such as a jail, prison, juvenile detention center, psychiatric hospital, etc.

2. Background Information

Many buildings are currently being constructed of concrete blocks or the like to form a masonry block wall. Moreover, certain buildings and public facilities, such as jails, prisons, juvenile detention centers, and psychiatric hospitals, often require the interior walls to be constructed of concrete blocks. To maximize security, these types of facilities have wall constructions that often require the interiors of the blocks to have cement poured into the cavity or cavities of the wall blocks. These wall constructions also often require that the cavities have one or more reinforcing rods extending from the interior of the blocks into the concrete blocks that are above and below.

One recent improvement in concrete block walls has been the use of steel blocks, which is disclosed in U.S. Pat. No. 5,649,391, issued to Harry R. Layne, on Jul. 22, 1997. This patent discloses a steel block, which is embedded into the concrete wall. This patent discloses welding the furniture or accessory to the wall. Moreover, this patent also teaches having fasteners formed on the steel block. However, this patent does not teach how to provide air ducts in concrete block walls.

In construction using concrete blocks, such as prison construction, ventilation is normally introduced into each room or cell via a ventilation or air duct that pierces the cell wall from the rear pipe chase. In construction of a new concrete block wall, the prior art requires the entire concrete block wall to be first constructed, and then the duct work is installed. The air duct openings are then formed in the concrete block wall by removing portions of the concrete block wall where air vents are desired. For an eight inch square air duct, this would require at least two concrete blocks to be cut from the wall to form an opening that will accommodate the duct work. This not only creates the problem of cutting concrete blocks in the concrete block wall, but also is quite involved in the patching process.

These conventional air ducts have sheet metal tubes that extend through the wall and with a perforated faceplate or vent panel that is fastened to the duct and the concrete block wall. The faceplate of the air duct often does not lie flush with the wall. Moreover, often an enlarged hole is made in the wall for mounting the air vent. This hole then has to be patched. Additionally, the air duct has a faceplate attached to the faceplate flanges that usually require caulking. The caulking around the faceplate flanges and/or the faceplate can later be removed by the prisoner. After removal of the caulking, the prisoner may be able to hide contraband around the air duct. Furthermore, such construction often requires cutting more than one block to create a sufficiently large opening for an air duct that provides adequate air flow.

It would be a benefit, therefore, to have an embeddable air duct block that could be used in connection with a wall that did not provide a gap between the wall and a mounting surface and that forms an integral part of the wall construction. It would also be desirable to have a method for mounting a fixture permanently to a concrete block wall that did not require degrading the wall structure by forming a cavity within the preexisting wall during installation of the fixture.

In view of the above, there exists a need for an air duct block which overcomes the above mentioned problems in the prior art. This invention addresses this need in the prior art as well as other needs, which will become apparent to those skilled in the art from this disclosure.

SUMMARY OF THE INVENTION

One object of the present invention is to provide an air duct block that is used to provide a permanent ventilation duct through a concrete block wall, a masonry wall or a pre-cast concrete wall.

Another object of the present invention is to provide an air duct block that will not require additional plastering or patching of the wall after installation.

A further object of the present invention is to provide and air duct block that eliminates the need for caulking around a duct opening.

A still further object of the present invention is to provide an air duct block that eliminates a place to hide contraband.

Yet another object of the present invention is to provide a steel vent or air duct block that will fit into the normal confines of the space occupied by one or more standard masonry blocks in either a horizontal position or vertical position to eliminate extra fitting by the mason as he installs the steel vent block.

The new air duct block in accordance with the present invention is designed to eliminate some of the problems that have been experienced by the construction industry. The air duct block of the present invention reduces the cost of installation and provides a permanently secured air duct block with a relatively simple construction. Preferably, the air duct block is the size of a pair of full size blocks laid vertically.

In accordance with one aspect of the present invention an embeddable air duct block is provided that includes a tubular member, a first rectangular plate member and a second rectangular plate member. The tubular member has a first open end, a second open end and an interior passageway extending between the first and second open ends. The first rectangular plate member has a first inner surface coupled to the first open end of the tubular member, a first outer surface, a first length, a first width, and a first thickness. The first rectangular plate member has a plurality of holes in fluid communication with the interior passageway of the tubular member. The second rectangular plate member is spaced from said first rectangular plate member and is coupled to the tubular member. The second rectangular plate member has a second inner surface, a second outer surface, a second length equal to the first length, a second width equal to the first width, a second thickness, and a duct opening aligned with the interior passageway of the tubular member.

The tubular member has a transverse length smaller than the first and second lengths such that at least one cavity is formed on one side of the tubular member. Additionally, the tubular member has a transverse width smaller than the first and second widths. Furthermore, the tubular member is spaced in a lengthwise direction from opposite ends of the first and second rectangular members such that a first cavity is formed on a first side of the tubular member and a second cavity is formed on a second side of the tubular member. Thus, the first and second cavities are connected to each other above and below the tubular member.

Additionally, with the embeddable air duct block of this aspect of the present invention, the tubular member extends through the duct opening of the second rectangular plate member to form a duct attachment portion. A pair of spacer members are coupled between the first and second rectangular plate members. The spacer members are spaced from the first and second sides of the tubular member to form end peripheries of the first and second cavities. Furthermore, each of the spacer members is a plate-shaped member with a flange extending therefrom. The embeddable air duct block of the present invention is formed of metal.

In accordance with another aspect of the present invention, a method of forming an air duct in a concrete block wall is provided that includes the steps of constructing the concrete block wall with a plurality of concrete blocks coupled together by a cementing slurry, and installing and securing an air duct block into the concrete block wall with the cementing slurry. The air duct block basically includes a tubular member, a first rectangular plate member and a second rectangular plate member. The tubular member has a first open end, a second open end and an interior passageway extending between the first and second open ends. The first rectangular plate member has a first inner surface coupled to the first open end of the tubular member, a first outer surface, a first length, a first width, and a first thickness. The first rectangular plate member has a plurality of holes in fluid communication with the interior passageway of the tubular member. The second rectangular plate member is spaced from said first rectangular plate member and is coupled to the tubular member. The second rectangular plate member has a second inner surface, a second outer surface, a second length equal to the first length, a second width equal to the first width, a second thickness, and a duct opening aligned with the interior passageway of the tubular member.

The tubular member has a transverse length smaller than said first and second lengths such that a cement cavity is formed on one side of said tubular member. Cementing slurring is poured into the cavities of the concrete blocks of the wall and into the cement cavity of the air duct block. At least one reinforcing bar is inserted into a cavity of at least one of the concrete blocks and into the cavity of the air duct block.

The tubular member is spaced in a lengthwise direction from opposite ends of said first and second rectangular members such that a first cement cavity is formed on a first side of said tubular member and a second cement cavity is formed on a second side of said tubular member. The cementing slurring is poured into cavities of the concrete block wall and into the first and second cement cavities of the air duct block. The two reinforcing bars are inserted into a cavity or cavities of the concrete block wall and into the first and second cement cavities of the air duct block, respectively.

The air duct block includes a pair of spacer members spaced from the first and second sides of said tubular member and coupled between the first and second rectangular plate members. Thus, the spacer members form first and second peripheries of said first and second cement cavities to retain the cementing slurry within the air duct block. The tubular member has a transverse width smaller than the first and second widths such that the first and second cement cavities are connected to each other above and below the tubular member and the air duct block is formed of metal. Thus, the air duct block can be easily installed and fixedly secured within the block wall using the method of the present invention.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
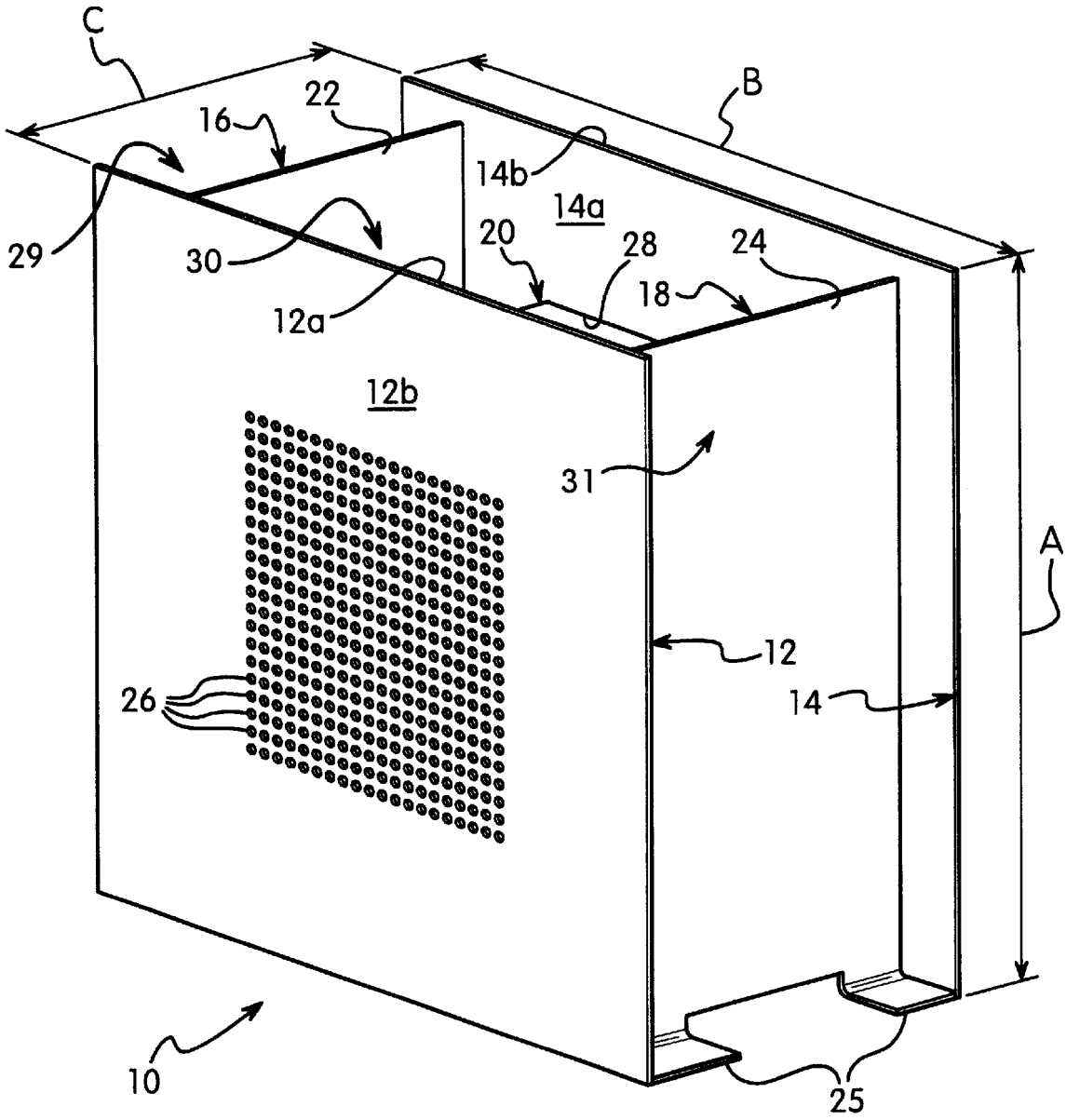
FIG. 1 is a front perspective view of an embeddable air duct block in accordance with a preferred embodiment of the present invention.
Figure 2:
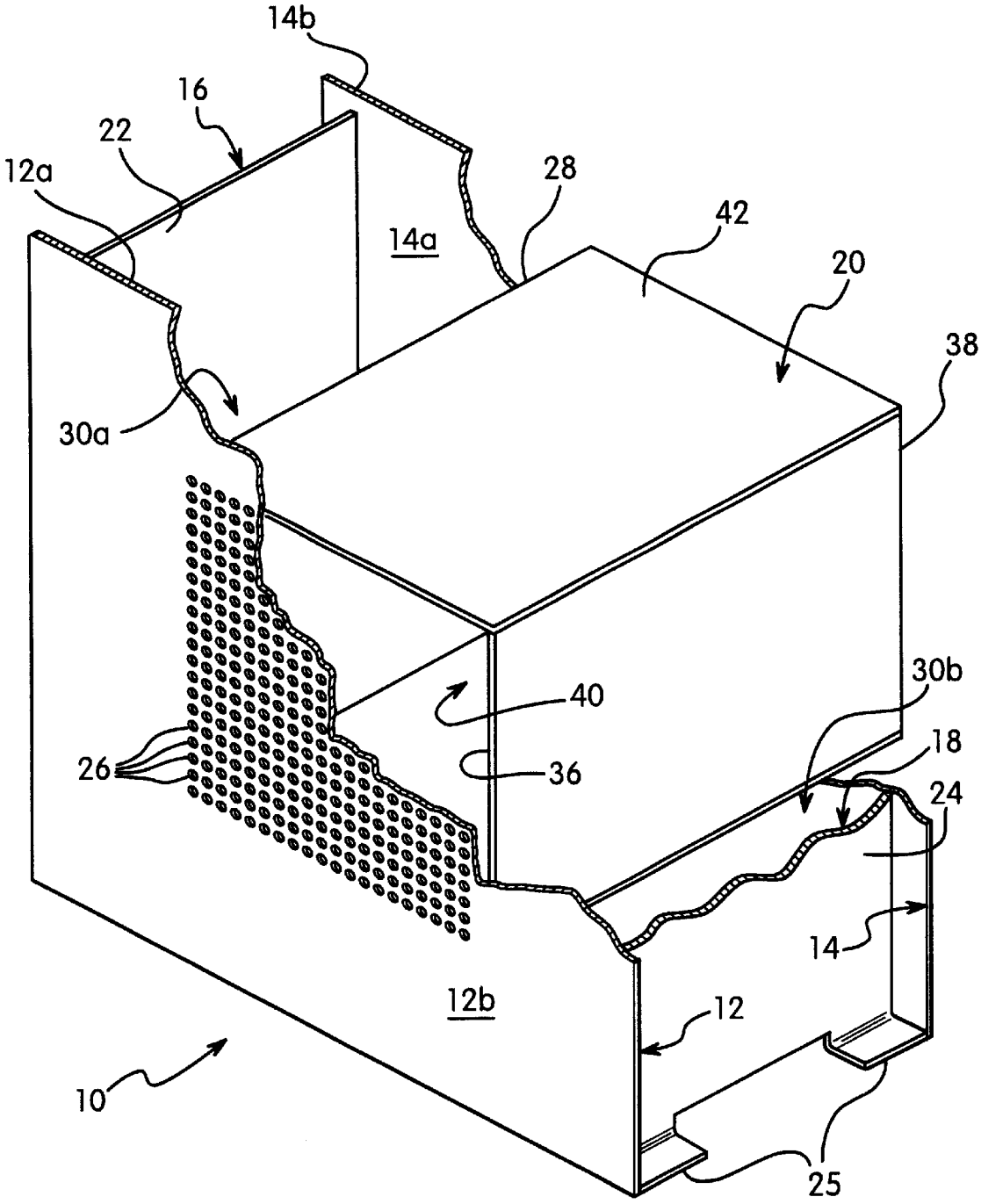
FIG. 2 is a front perspective view of an embeddable air duct block illustrated in FIG. 1 with a portion broken away for purposes of illustration.
Figure 3:
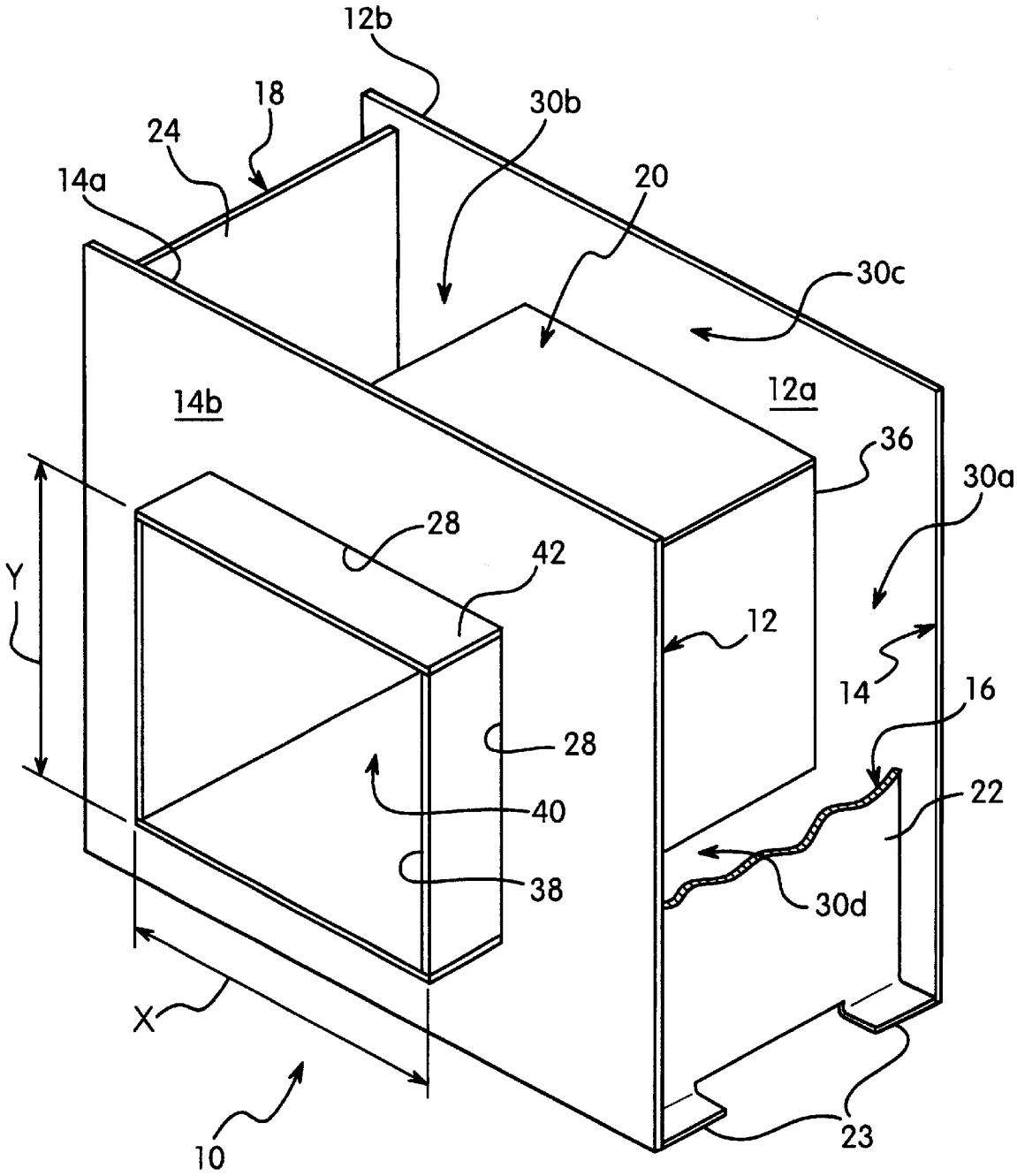
FIG. 3 is a rear perspective view of an embeddable air duct block illustrated in FIGS. 1 and 2 with a portion broken away for purposes of illustration.
Figure 4:
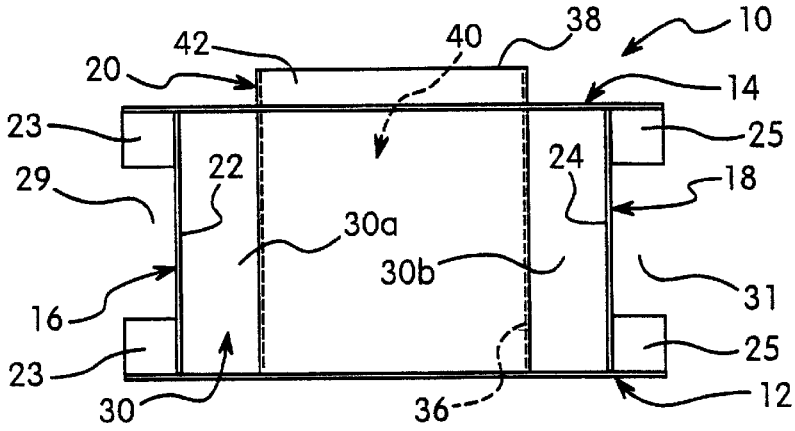
FIG. 4 is a top plan view of the embeddable air duct block illustrated in FIGS. 1–3 in accordance with the preferred embodiment of the present invention.
Figure 5:
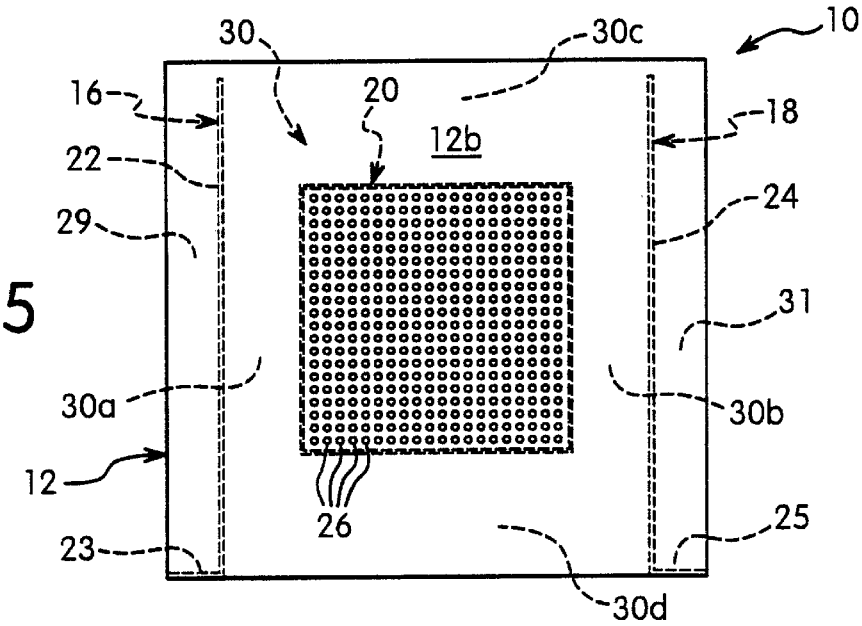
FIG. 5 is a front elevational view of the embeddable air duct block illustrated in FIGS. 14 in accordance with the preferred embodiment of the present invention.
Figure 6:
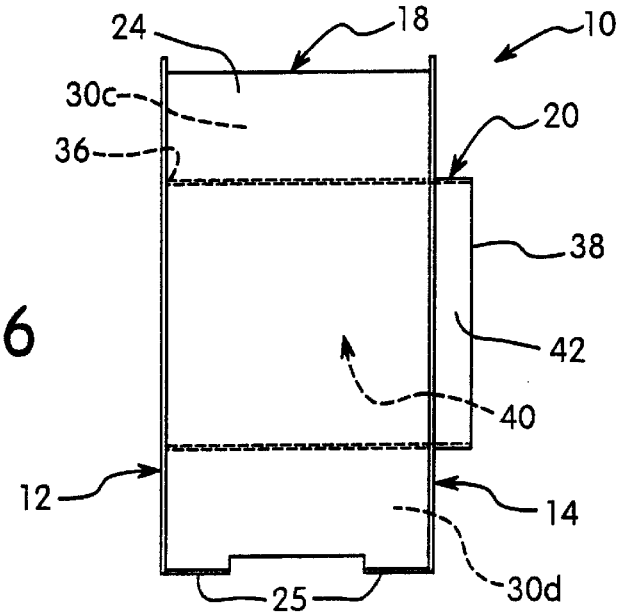
FIG. 6 is a right side elevational view of the embeddable air duct block illustrated in FIGS. 1–5 in accordance with the preferred embodiment of the present invention.
Figure 7:
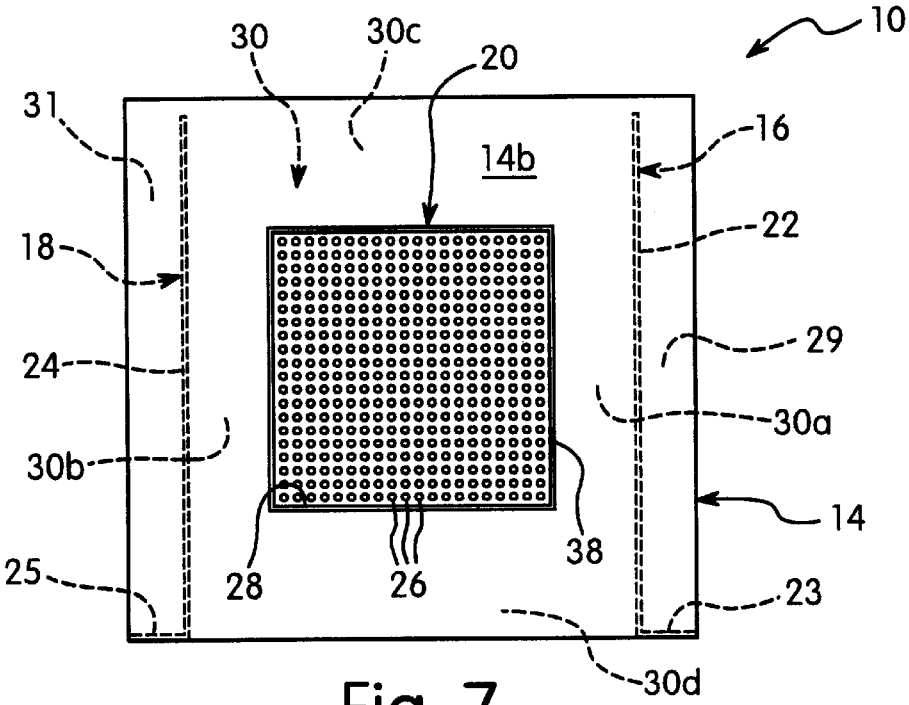
FIG. 7 is a rear elevational view of the embeddable air duct block illustrated in FIGS. 1–6 in accordance with the preferred embodiment of the present invention.
Figure 9:
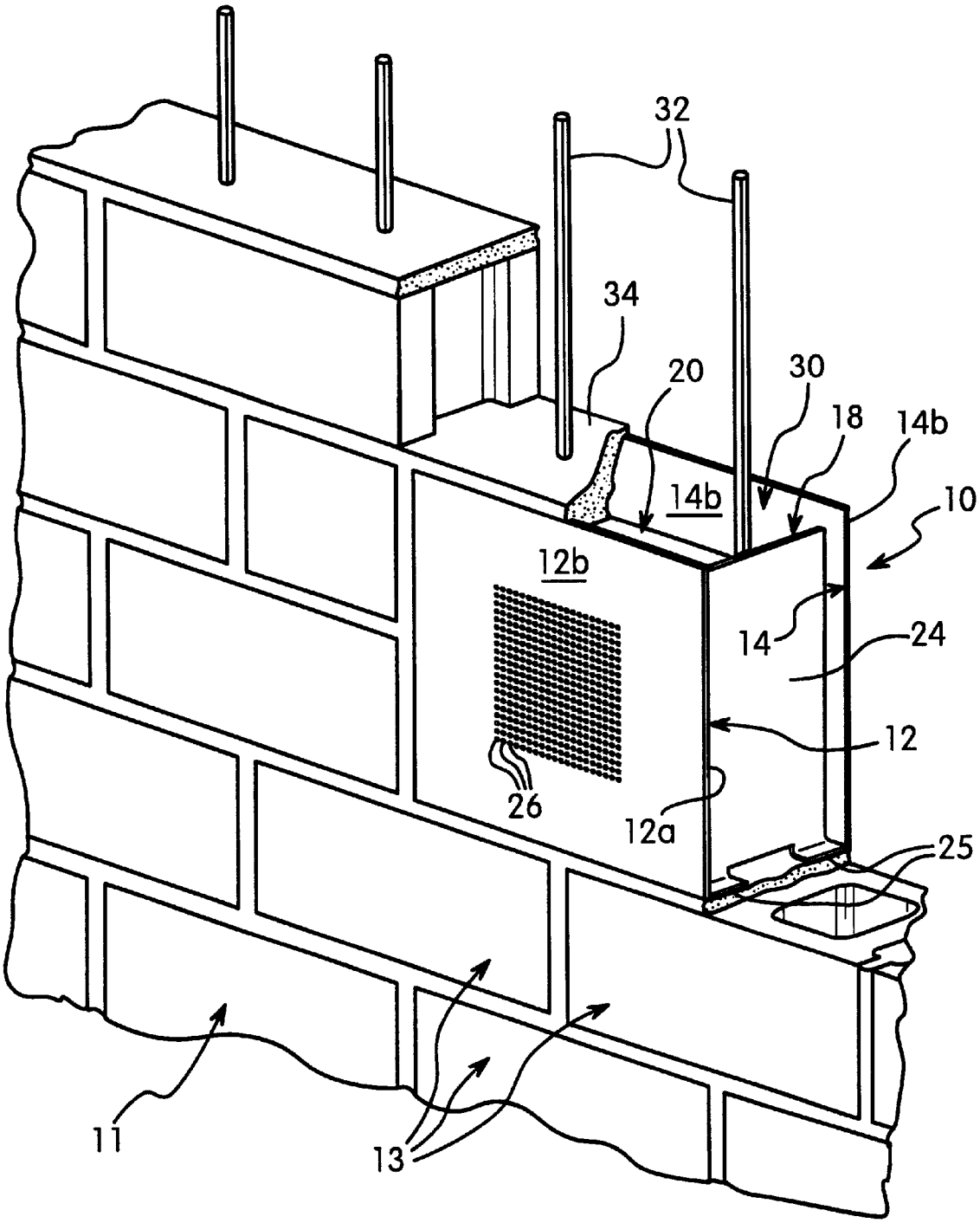
FIG. 9 is a partial perspective view of the embeddable air duct block illustrated in FIGS. 1–8 after being partially mounted in a block wall in accordance with the preferred embodiment of the present invention.

Referring initially to FIGS. 1–3, an embeddable air duct or vent block 10 is illustrated in accordance with one embodiment of the present invention. Air duct block 10 basically includes a pair of generally rectangular members 12 and 14, a pair of spacer members 16 and 18, and a tubular member 20. Preferably, these members are all constructed of metal plates to form a metal block with an air passage between members 12 and 14. The members 12, 14, 16, 18 and 20 are preferably fixedly coupled together by welding or other fastening means. As seen in FIG. 9, the embeddable air duct block 10 is embedded within a masonry block wall 11 constructed of blocks 13 such as cinder blocks, concrete blocks or masonry blocks. The embeddable air duct block 10 is designed to be grouted just like the cinder blocks, concrete blocks or masonry blocks 13. Thus, the steel vent or air duct block 10 fits into the normal confines of the space occupied by one or more standard masonry blocks in either a horizontal position or vertical position to eliminate extra fitting by the mason as he installs the steel vent block 10.

As seen in FIG. 9, the embeddable air duct block 10 preferably has a square block that is sized to be substantially equal in length and twice the height of one of the blocks 13. As seen in FIG. 1, the embeddable air duct block 10 has a height or width "A", a length "B" and a depth "C". The height "A" is preferably between about seven inches and seventeen inches. The length "B" is preferably between about seven inches and seventeen inches. The depth "C" is preferably between seven inches and nine inches. More specifically, in the illustrated embodiment, air duct block 10 preferably has a height "A" of approximately fifteen and five-eighths (15⅝") inches, a length "B" of approximately fifteen and five-eighths (15⅝") inches and a depth "C" of approximately seven and five-eighths (7⅝") inches. This size of block 10 allows the block to completely fill the space normally occupied by a pair of full cinder blocks, concrete blocks or masonry blocks, and allows adequate ventilation without sacrificing strength. While the embeddable air duct block 10 is illustrated as a double block (i.e. the size of two cinder blocks stacked together), it will be apparent to those skilled in the art from this disclosure that the air duct block 10 can have other sizes as needed and/or desired. For example, air duct block 10 could be constructed to be the size of a single full block, i.e., the same size as the cinder blocks, concrete blocks or masonry blocks 13. Of course, the dimensions of the air duct block 10 will depend on the size of the blocks and the mortaring procedures used in constructing the wall.

It will also be apparent to those skilled in the art from this disclosure that plate members 12 and 14, spacer members 16 and 18, and tubular member 20 can be constructed of several plates which are fixedly secured together by suitable means such as welding. Moreover, it will be apparent to those skilled in the art from this disclosure that some of these plate members 12 and 14, spacer members 16 and 18, and tubular member 20 can be constructed from a single plate which is bent to form two or more of the metal plate members. For example, the first and second rectangular plate members 12 and 14 can be integrally formed by bending a single metal plate into a U-shaped member.

In the illustrated embodiment, the first and second rectangular plate members 12 and 14 are both preferably constructed of ten gauge mild steel plates (ASTM A-36) and have first and second thicknesses, which are substantially equal to each other. However, lesser gauges of steel can be used if applicable. The first and second rectangular plate members 12 and 14 each have a height "A" of about fifteen and five-eighths (15⅝") inches, a length "B" of about fifteen and five-eighths (15⅝") inches. The depth "C" of block 10 is preferably about seven and five-eighths (7⅝") inches, as mentioned above. In other words, first and second rectangular plate members 12 and 14 and preferably formed as regular rectangles or square plates. Of course, it will be apparent to those skilled in the art from this disclosure that the embeddable air duct block 10 can be other sizes depending upon the cinder blocks, concrete blocks or masonry blocks being used therewith.

Referring now to FIGS. 4–8, the first and second rectangular metal plate members 12 and 14 are planar members, which are secured together by the first and second spacer members 16 and 18 so as to be spaced a predetermined distance apart from each other. The first and second spacer members 16 and 18 hold the first and second rectangular metal plate members 12 and 14 substantially parallel to each other. Moreover, in the illustrated embodiment, spacer members 16 and 18 are preferably substantially parallel to each other. Three concrete or cement receiving cavities 29, 30 and 31 are formed between the first and second rectangular metal plate members 12 and 14 and the first and second spacer members 16 and 18. As seen in FIG. 9, the cavity 30 is designed to receive reinforcing bars 32 and cement 34 therein.

Referring again to FIGS. 4–8, first rectangular plate member 12 preferably has a first inner surface 12*a*, a first outer surface 12*b* and a plurality of holes 26 formed therein. Holes 26 are in fluid communication with tubular member 20, as will be discussed in more detail below. Preferably, each hole has a diameter of about one-fourth (¼") inch. Additionally, adjacent holes 26 are spaced about three-eighths (⅜") inch on center. Thus, adequate strength of rectangular plate member 12 can be maintained. In the illustrated embodiment, first rectangular plate member 12 has four hundred (400) holes 26 formed generally in a grid pattern. In other words, in the illustrated embodiment there are twenty (20) rows of twenty (20) holes 26 such that a square pattern of holes 26 is formed. With this arrangement all four hundred (400) holes 26 are formed within an eight (8") inch square area in the center of plate 12. Moreover, with this arrangement, an open area of about sixteen and thirty-seven one hundredths ($16^{37}/_{100}$ in$^2$) square inches is provided without compromising the strength of rectangular plate 12.

Second rectangular plate member 14 preferably has a second inner surface 14*a* , a second outer surface 14*b* and a duct opening 28 formed therein sized to receive tubular member 20 therein. Duct opening 28 is preferably a centrally located square opening with an internal size corresponding to the external size of tubular member 20. In any event, duct opening 28 is aligned with tubular member 20. Rectangular plate member 28 is coupled to tubular member 20 at opening 28. Preferably, plate member 14 and tubular member 20 are welded together at opening 28 around the external surface of tubular member 20. Tubular member 20 is preferably sized to completely surround holes 26 of first rectangular plate member 12, as discussed in more detail below. Thus, when air duct block 10 is completely assembled, a fluid passageway is provided through tubular member 20 mounted in duct opening 28 and through holes The first and second spacer members 16 and 18 are also preferably constructed from ten gauge mild steel plate (ASTM A-36). The first and second spacer members 16 and 18 can have the same or a smaller height than the first and second rectangular plate members 12 and 14. In the illustrated embodiment, first and second spacer members 16 and 18 have a height of about fifteen and one-eighth (15⅛") inches. In other words, spacer members 16 and 18 are preferably about one-half (½") inch shorter than rectangular plate members 12 and 14. Moreover, the height of the first and second spacer members 16 and 18 can vary if needed and/or desired.

First spacer member 16 preferably includes a first leg 22 and a pair of first bent end flanges 23 extending from first second leg 22. Second spacer member 18 preferably includes a second leg 24, and a pair of second bent end flange 25 extending from second leg 24. First and second bent end flanges 23 and 25 preferably extend outwardly from the bottom ends of first and second legs 22 and 24, respectively to form right angles with legs 22 and 24. Each end flange 23 and 25 preferably has an length of about one and five-eighths (1⅝") inches and a transverse width of one and thirteen-sixteenths ($1^{13}/_{16}$") inches. The end flanges 23 are spaced about four inches apart. Likewise, the end flanges 25 are also spaced about four inches apart. The free ends of end flanges 23 and 25 are preferably axially aligned with free ends of the first and second rectangular plate members 12 and 14, and arranged between the bottom edges of rectangular plate members 12 and 14. Each of the spacer members 16 and 18 is preferably formed as a one-piece unitary metal member by bending an elongated rectangular plate.

Tubular member 20 basically includes a first open end 36, a second open end 38 and an interior passageway 40 extending between the first and second open ends 36 and 38. Preferably, tubular member 20 is formed of ten or fourteen gauge mild steel (ASTM A-36). Tubular member 20 can be formed of sheet material bent into the desired shape, and welded at a longitudinal seam. Alternatively, tubular member 20 could be cut from an elongated tubular element and molded to the desired shape. First open end 36 is coupled to first inner surface 12*a* of first rectangular plate member 12. Second rectangular plate member 14 is spaced from first rectangular plate member 12 and also coupled to tubular member 20. More specifically, first and second rectangular plate members 12 and 14 are preferably fixedly coupled to tubular member 20 by welding. Of course, it will be apparent to those skilled in the art from this disclosure that first and second rectangular plate members 12 and 14, and tubular member 20 could be formed of other materials, or be fixedly coupled by other conventional methods, as needed and/or desired.

In the illustrated embodiment, tubular member 20 has a generally square-shaped cross-section measuring approximately eight (8") inches by eight (8") inches. Such that first open end 36 completely surrounds holes 26 formed in first rectangular plate member 12. Duct opening 28 of second rectangular member 14 is also preferably an eight (8") inch by eight (8") inch square opening, or a slightly larger opening, such that tubular member 20 can be received therein. Of course, it will be apparent to those skilled in the art from this disclosure that tubular member 20 could have other configurations as needed and/or desired. For example, tubular member 20 could have a circular cross-section. In any event, holes 26 of first rectangular plate member 12 are arranged in a pattern that corresponds to the cross-sectional shape of tubular member 20. Moreover, holes 26 are configured to fit within the interior passageway 40 of tubular member 20. Additionally, duct opening 28 of second rectangular plate member 14 also preferably has the same shape as tubular member Holes 26, tubular member 20 and duct opening 28 are designed to provide adequate air flow through air duct block 10.

As mentioned above, tubular member 20 is preferably formed as an eight (8") inch by eight (8") inch square cross-sectional member. Thus, tubular member 20 has a transverse dimension "X" smaller than first and second lengths "B" of first and second rectangular members 12 and 14, such that at least one vertical opening or through cavity is formed on one side of tubular member 20. More specifically, tubular member 20 is preferably centered, or at least spaced in a lengthwise direction from opposite ends of first and second rectangular members 12 and 14, such that a first vertical opening or through cavity 30*a* is formed on a first side of tubular member 20, and a second vertical opening or through cavity 30*b* is formed on a second side of tubular member 20. Thus, reinforcing bars 32 can be inserted on opposite sides of tubular member 20 to secure air duct block 10 within block wall 11.

Tubular member 20 also preferably has a vertical dimension "Y" smaller than first and second height "A" of first and second rectangular plate members 12 and 14.

In other words, cavity 30 is preferably a generally annular, rectangular cavity surrounding tubular member 20. Thus, the center cavity 30 includes first and second horizontal cavities 30*c* and 30*d* that are preferably located above and below tubular member 20. Cementing slurry 34 surrounds tubular member 20 during construction of block wall 11 to secure air duct block 10 against vertical and horizontal movement.

Figure 8:
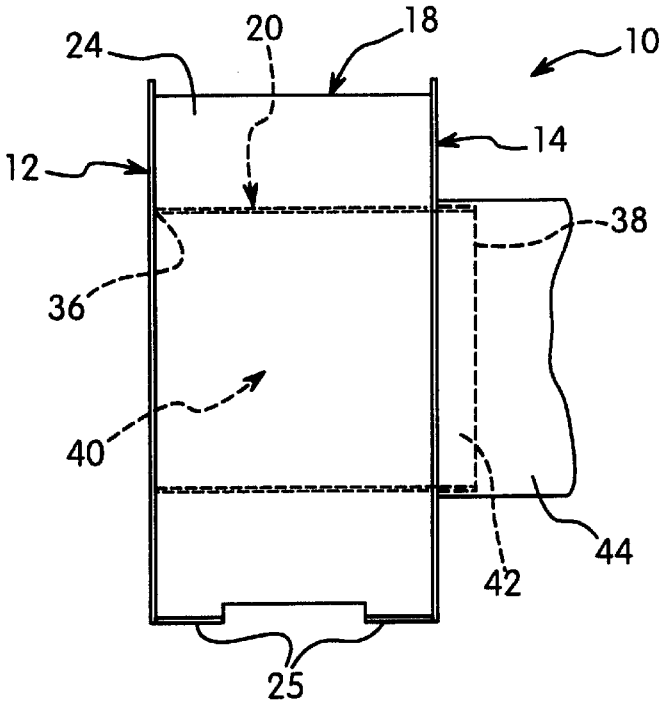
FIG. 8 is a right side elevational view of the embeddable air duct block illustrated in FIGS. 1–7 with an air duct attached thereto in accordance with the preferred embodiment of the present invention.

Referring still to FIGS. 4–8, tubular member 20 preferably extends through duct opening 28 of second rectangular plate member 14. In other words, tubular member 20 has a longitudinal width larger than longitudinal depth "C" of air duct block 10. More specifically, second open end 38 of tubular member 20 preferably extends about one (1") inch beyond second outer surface 14*b* of second rectangular plate member 14 to form a duct attachment portion 42 of air duct block 10. As best seen in FIG. 8, an air duct 44 is coupled to duct attachment portion 42 of tubular member 20. In the illustrated embodiment, air duct 44 surrounds the exterior surface of second open end 38 of tubular member 20. However, it will be apparent to those skilled in the art that air duct 44 can be coupled to air duct block in any conventional manner, such as welding, press-fit, clamping, or the like.

Construction of air duct block 10 will now be discussed in more detail. As mentioned above, first and second rectangular plate members 12 and 14, first and second spacers 16 and 18, and tubular member 20 are preferably welded together in a conventional manner. More specifically, first and second rectangular plate members 12 and 14 are preferably welded to tubular member 20 about an external surface of tubular member 20. In other words, tubular member 20 is free of welds within interior passageway 40. First and second spacer members 16 and 18 are also preferably welded to first and second rectangular plate members 12 and 14 in a relatively conventional manner.

Of course, it will be apparent to those skilled in the art that spacer members 16 and 18 could have other configurations, and be fixedly coupled to first and second rectangular plate members 12 and 14 by other conventional mounting methods, without departing from the scope of the present invention. However, first and second spacers 16 and 18 are preferably welded to first and second rectangular plate members 12 and 14 to create an extremely strong, secure air duct block 10.

Of course, it will also be apparent to those skilled in the art that tubular member 20 could have other configurations in order to be connected to the first and second rectangular plate members 12 and 14 using alternative manufacturing techniques. For example, tubular member 20 could be formed with mounting flanges such that the tubular member could be coupled to first and second rectangular plate members 12 and 14 by rivets or bolts. However, tubular member 20 is preferably welded to first and second rectangular plate members 12 and 14 to create an extremely strong, secure air block 10. Moreover, by coupling tubular member 20 and first and second rectangular plate members 12 and 14 to each other by welding, an air tight seal for the air duct is created.

While in the illustrated embodiment, tubular member extends beyond the outer surface 14*b* of second rectangular plate member 14 to form a duct attachment portion 42, it will be apparent to those skilled in the art that various configurations of second open end 38 of tubular member 20 could be utilized without departing from the scope of the present invention. For example, tubular member 20 could be designed as a shorter member that is completely arranged between first and second inner surfaces 12*a* and 14*a* of plates 12 and 14. In such an air duct block, air duct 44 could be either welded to second outer surface 14*b,* or have a slightly smaller diameter than tubular member 20 such that air duct 44 could be press-fitted into tubular member 20. In other words, tubular member 20 could be welded to first and second interior surfaces 12*a* and 14*a,* and have a length approximately one inch shorter than illustrated in the preferred embodiment.

Referring again to FIG. 9, perspective view of a partially constructed concrete block wall 11 is illustrated. Block wall 11 is constructed from a plurality of conventional blocks 13 such as cinder blocks, concrete blocks or masonry blocks. Each of the blocks 13 includes a pair of cement receiving cavities 13*a*. An air duct block 10 is shown installed between the concrete blocks 13 so that the air duct block 10 becomes an integral part of concrete block wall 11.

An exemplary method of installing the embeddable air duct block 10 into the concrete block wall 11 will now be described with general reference to FIGS. 1–3 and particular reference to FIGS. 8 and 9. In this exemplary method of permanently attaching and embedding the air duct block 10 into the concrete block wall 11, the method includes the step of installing at least one air duct block 10, as described above, into the concrete block wall 11 in place of one of the blocks 13 during construction of the concrete block wall 11. Installation of air duct block 10 is as follows. First, the cinder, concrete or masonry blocks 13 are laid down to begin construction of the concrete wall.

Next, the air duct block 10 is placed unto one or more of the cinder, concrete or masonry blocks 13 of the concrete wall 11 in a desired location. One of the reinforcing bars 32 is received in the cavity 30 of the air duct block 10. The cavity 30 is at least partially aligned with one of the cement receiving cavities 13*a* of one of the cinder, concrete or masonry blocks 13. With the vertical reinforcing bars 32 in place, a cementing slurry mixture 34 is then poured into the cavities 13*a* and 30 in a manner such that the vertical reinforcing bars 32 and a quantity of the cementing slurry mixture 34 fill the cement receiving cavity 30 of air duct block 10 and the cement receiving cavities 13*a* of cinder, concrete or masonry blocks 13. The cementing slurry mixture 34 is then allowed to harden while the concrete wall is fully constructed. Alternatively, block wall 11 can be constructed without reinforcing bars 32. However, reinforcing bars 32 add extra strength and security to block wall 11. Of course, in some applications the cementing slurry 34 can provide adequate strength and reduced costs. However, reinforcing bars 32 are preferred in order to provide an extremely strong, secure block wall 11.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. An embeddable air duct block comprising:

a tubular member having a first open end, a second open end and an interior passageway extending between said first and second open ends;

a first rectangularly shaped rigid plate member having a first inner surface coupled to said first open end, a first outer surface, a first length, a first width, and a first thickness, said fast plate member being formed as a one-piece plate member consisting of a first area and a second area, said first area having a plurality of holes formed therein and said second area being absent any holes, all of said holes of said first area being aligned with said interior passageway such that said holes are in fluid communication with said interior passageway; and a second rectangularly shaped plate member spaced from said first plate member and coupled to said tubular member, said second plate member having a second inner surface, a second outer surface, a second length, a second width, a second thickness, and a duct opening aligned with said interior passageway.

2. An embeddable air duct block according to claim 1, wherein said first and second lengths of said first and second plate members are equal to each other; and said first and second widths of said first and second plate members are equal to each other.

3. An embeddable air duct block according to claim 1, wherein said tubular member has a transverse length smaller than said first and second lengths such that at least one cavity is formed on one side of said tubular member.

4. An embeddable air duct block according to claim 3, wherein said tubular member has a transverse width smaller than said first and second widths.

5. An embeddable air duct block according to claim 3, wherein said tubular member is spaced in a lengthwise direction from opposite ends of said first and second plate members such that a first cavity is formed on a first side of said tubular member and a second cavity is formed on a second side of said tubular member.

6. An embeddable air duct block according to claim 5, wherein said tubular member extends through said duct opening of said second plate member.

7. An embeddable air duct block according to claim 5, further comprising:

a pair of spacer members spaced from said first and second sides of said tubular member and coupled between said first and second rectangular plate members.

8. An embeddable air duct block according to claim 3, wherein said air duct block is formed of metal.

9. An embeddable air duct block according to claim 3, wherein said first and second lengths of said first and second plate members are equal to each other; and said first and second widths of said first and second plate members are equal to each other.

10. An embeddable air duct block comprising:

a tubular member having a first open end, a second open end and an interior passageway extending between said first and second open ends;

a first rectangularly shaped plate member having a first inner surface coupled to said first open end, a first outer surface, a first length, a first width, and a first thickness, said first plate member having a plurality of holes in fluid communication with said interior passageway; and a second rectangularly shaped plate member spaced from said first plate member and coupled to said tubular member, said second plate member having a second inner surface, a second outer surface, a second length, a second width, a second thickness, and a duct opening aligned with said interior passageway, said tubular member extending through said duct opening of said second plate member.

11. An embeddable air duct block according to claim 10, wherein said first and second lengths of said first and second plate members are equal to each other; and said first and second widths of said first and second plate members are equal to each other.

12. An embeddable air duct block according to claim 10, wherein said tubular member has a transverse length smaller than said first and second lengths such that at least one cavity is formed on one side of said tubular member.

13. An embeddable air duct block according to claim 12, wherein said tubular member has a transverse width smaller than said first and second widths.

14. An embeddable air duct block according to claim 12, wherein said tubular member is spaced in a lengthwise direction from opposite ends of said first and second rectangular members such that a first cavity is formed on a first side of said tubular member and a second cavity is formed on a second side of said tubular member.

15. An embeddable air duct block comprising:

a tubular member having a first open end, a second open end and an interior passageway extending between said first and second open ends;

a first rectangularly shaped plate member having a first inner surface coupled to said first open end, a first outer surface, a first length, a first width, and a first thickness, said first plate member having a plurality of holes in fluid communication with said interior passageway;

a second rectangularly shaped plate member spaced from said first plate member and coupled to said tubular member, said second plate member having a second inner surface, a second outer surface, a second length, a second width, a second thickness, and a duct opening aligned with said interior passageway; and a pair of spacer members coupled between said first and second plate members.

16. An embeddable air duct block according to claim 15, wherein each of said spacer members is a plate-shaped member with a flange extending therefrom.

17. An embeddable air duct block according to claim 15, wherein said first and second lengths of said first and second plate members are equal to each other; and said first and second widths of said first and second plate members are equal to each other.

18. An embeddable air duct block according to claim 15, wherein said tubular member has a transverse length smaller than said first and second lengths such that at least one cavity is formed on one side of said tubular member.

19. An embeddable air duct block according to claim 18, wherein said tubular member has a transverse width smaller than said first and second widths.

20. An embeddable air duct block according to claim 18, wherein said tubular member is spaced in a lengthwise direction from opposite ends of said first and second rectangular members such that a first cavity is formed on a first side of said tubular member and a second cavity is formed on a second side of said tubular member.

21. A method of forming an air duct in a block wall, comprising the steps of:

constructing said block wall with a plurality of blocks coupled together by a cementing slurry;

installing and securing an air duct block into said block wall with said cementing slurry, said air duct block comprising:

a tubular member having a first open end, a second open end and an interior passageway extending between said first and second open ends;

a first rectangularly shaped plate member having a first inner surface coupled to said first open end, a first outer surface, a first length, a first width, and a first thickness, said first plate member having a plurality of holes in fluid communication with said interior passageway; and a second rectangularly shaped plate member spaced from said first plate member and coupled to said tubular member, said second plate member having a second inner surface, a second outer surface, a second length, a second width, a second thickness, and a duct opening aligned with said interior passageway.

22. The method according to claim 21, wherein said tubular member has a transverse length smaller than said first and second lengths such that a cement cavity is formed on one side of said tubular member.

23. The method according to claim 22, further comprising the step of:

pouring said cementing slurring into at least one cavity of said block wall and into said cement cavity of said air duct block.

24. The method according to claim 23, further comprising the steps of:

providing a reinforcing bar;

inserting said reinforcing bar into said at least one cavity of said block wall and into said cavity of said air duct block.

25. The method according to claim 22, wherein said tubular member is spaced in a lengthwise direction from opposite ends of said first and second plate members such that said cement cavity is a first cement cavity that is formed on a first side of said tubular member, and a second cement cavity is formed on a second side of said tubular member.

26. The method according to claim 25, further comprising the step of:

pouring said cementing slurring into at least one cavity of said block wall and into said first and second cement cavities of said air duct block.

27. The method according to claim 26, further comprising the steps of:

providing a pair of reinforcing bars;

inserting said reinforcing bars into said at least one cavity of said block wall and into said first and second cement cavities of said air duct block.

28. The method according to claim 27, wherein said air duct block includes a pair of spacer members spaced from said first and second sides of said tubular member and coupled between said first and second plate members, said spacer members forming first and second peripheries of said first and second cement cavities.

29. The method according to claim 27, wherein said tubular member has a transverse width smaller than said first and second widths such that said first and second cement cavities are connected to each other.

30. The method according to claim 21, wherein said air duct block is formed of metal.

31. The method according to claim 21, wherein said first and second lengths of said first and second plate members are equal to each other; and said first and second widths of said first and second plate members are equal to each other.

32. The method according to claim 21, wherein said plurality of blocks of said block wall are concrete blocks.

33. An embeddable air duct block comprising:

a tubular member having a first open end, a second open end and an interior passageway extending between said first and second open ends;

a first rectangularly shaped rigid plate member having a first planar inner surface coupled to said first open end, a first planar outer surface, a first length, a first width, and a first thickness, said first plate member having a plurality of holes formed therein, all of said holes extending between said first planar inner surface and said second planar outer surface and being aligned with said interior passageway such tat said holes are in fluid communication with said interior passageway; and a second rectangularly shaped plate member spaced from said first plate member and coupled to said tubular member, said second plate member having a second inner surface, a second outer surface, a second length, a second width, a second thickness, and a duct opening aligned with said interior passageway.

34. An embeddable air duct block comprising:

a tubular member having a first open end, a second open end and an interior passageway extending between said first and second open ends;

a first rectangularly shaped rigid plate member having a first inner surface coupled to said first open end, a first outer surface, a first length, a first width and a first thickness, said first plate member having a plurality of holes formed therein, all of said holes being aligned with said interior passageway such that said bales are in fluid communication with said interior passageway, a majority of said first plate member being absent of any holes; and a second rectangularly shaped plate member spaced from said first plate member and coupled to said tubular member, said second plate member having a second inner surface, a second outer surface, a second length, a second width, a second thickness, and a duct opening aligned with said interior passageway.

* * * * *